US005424723A

United States Patent [19]

Krebs

[11] Patent Number: 5,424,723

[45] Date of Patent: Jun. 13, 1995

[54] APPARATUS AND METHODS FOR CHECKING THE PRESENCE OF YARNS ON A TEXTILE MACHINE

[75] Inventor: Walter Krebs, Bad Ragaz, Switzerland

[73] Assignee: Zellweger Luwa AG, Uster, Switzerland

[21] Appl. No.: 77,678

[22] Filed: Jun. 16, 1993

[30] Foreign Application Priority Data

Jun. 17, 1992 [CH] Switzerland ..... 01-909/92

[51] Int. Cl.[6] ..... G08B 21/00

[52] U.S. Cl. ..... 340/677; 340/522; 340/555; 340/665

[58] Field of Search ..... 340/677, 522, 555–557, 340/665, 561–562; 200/61.42; 28/187; 66/163–164

[56] References Cited

U.S. PATENT DOCUMENTS 4,133,207 1/1979 Weidmann et al. ..... 340/677 X
4,311,958 1/1982 Aeppli ..... 340/677 X
4,525,705 6/1985 Edme et al. ..... 340/677
4,772,800 9/1988 Kanai et al. ..... 250/561
4,805,276 2/1989 Plaschy ..... 28/187
4,827,090 5/1989 Nuerk ..... 340/677 X

FOREIGN PATENT DOCUMENTS 3822984 4/1990 Germany .

*Primary Examiner*—Brent Swarthout
*Assistant Examiner*—Thomas J. Mullen, Jr.
*Attorney, Agent, or Firm*—Burns, Doane, Swecker & Mathis

[57] ABSTRACT

The presence of yarns of a tentered yarn layer on a textile machine is checked by traversing a feeler transversely across a row of the threads to deflect the yarns. A pressure sensor of the feeler deflects each deflected yarn and generates a signal in response thereto. An optical sensor of the feeler detects each yarn and generates a second signal in response thereto which is compared to the first signal.

18 Claims, 4 Drawing Sheets

APPARATUS AND METHODS FOR CHECKING THE PRESENCE OF YARNS ON A TEXTILE MACHINE

BACKGROUND OF THE INVENTION

The present invention relates to methods and apparatus for checking the presence of yarns of a tentered yarn layer on a textile machine, by means of a measuring feeler, movable relative to the yarn layer.

Arrangements of this type, when used as warp motion stop devices on weaving machines, can replace the known drop wires of warp motion stop devices. As is known, these drop wires are lined up on the warp yarns and fall onto a contact rail when a yarn breaks, thereby generating an electrical Signal. Since an additional stress on the warp yarns is caused by the drop wires of the warp motion stop device. Moreover, since the warp yarns have to be drawn into the drop wires, there has long been the need for a replacement for the known drop wires of warp motion stop devices. This need could be met in principle by a measuring feeler which moves relative to the yarn layer for sensing individual yarns.

The main requirement of such a measuring feeler arrangement for checking the presence of the yarns of a weaving warp is, of course, the absolutely reliable detection of yarn breaks, but this cannot be guaranteed with purely optical systems. Optical systems (see, for example, DE-A-3,832,984 and U.S. Pat. No. 4,772,800) have therefore been unsuccessful hitherto, and sensing means with mechanical feelers have been proposed. In a sensing means of this mechanical type described, for example, in U.S. Pat. No. 4,525,705, a feeler with a tracer rod is provided, and when the latter is deflected out of a position of equilibrium a circuit is closed and the presence of a yarn is thereby indicated. By counting these yarns consecutively and by comparing the sum with the known number of yarns, the number of yarn breaks, which corresponds to the difference in the two values, can be determined.

Since a sufficiently large deflection of the tracer rod is necessary for a reliable detection of the individual yarns, the arrangement described in U.S. Pat. No. 4,525,705 cannot satisfy the customary requirements for a warp motion stop device, at least where dense warps are concerned.

SUMMARY OF THE INVENTION

The present invention offers a equivalent replacement for known warp motion stop devices and which allows a reliable detection of the yarns of a yarn set.

This object is achieved, according to the invention, in that the measuring feeler has a yarn-guide part which deflects each yarn out of a position of rest and subsequently releases it, first a loading and then a relief of the yarn-guide part taking place, and in that a first sensor for detecting this loading and/or relief is provided.

In particular, an apparatus aspect of the invention checks the presence of yarns of a tentered yarn layer on a textile machine. That apparatus comprises a feeler movable relative to a row of the yarns in a direction transversely of a direction of yarn travel. The feeler includes a yarn deflector for temporarily deflecting each yarn such that loads are applied to the deflector as the deflector encounters respective yarns, and a sensor for sensing the load characteristics to provide a signal indicating the status of the yarns.

A preferred embodiment of the arrangement according to the invention is characterized in that the yarn-guide part has an inclined guide flank, and in that downstream of the latter is provided a second sensor for detecting the passage of the yarn released by the guide flank.

In the arrangement according to the invention, therefore, the yarns to be monitored are first tensioned and then released by the measuring feeler. The latter takes place abruptly and can therefore be detected relatively simply and reliably, the first sensor being formed preferably by a force transducer of the yarn-guide part and by a piezo electric converter cooperating with this force transducer. The second sensor, which can be an optical or capacitive sensor, allows a double measurement and increases the reliability of detection of the yarns.

Furthermore, the two sensors compliment one another: the first sensor does not react to broken yarns to which the second sensor may react (i.e., yarns which the second sensor records as normal yarns); and the second sensor recognizes as double yarns a yarn body which the first sensor may have evaluated as a single yarn. The differing behavior of the two sensors in respect of broken yarns also allows a direct and immediate detection of yarn breaks by means of a comparison of the signals from the two sensors.

The invention relates further to a method of checking the presence of yarns of a tentered yarn layer on a textile, machine. That method involves: traversing a feeler transversely of a direction of yarn travel to deflect the yarns; causing a pressure sensor of the feeler to contact each deflected yarn and generate a first signal in response thereto; causing a second sensor of the feeler to detect each yarn and generate a second signal in response thereto; and comparing the first and second signals.

The invention relates further to a use of the arrangement as a warp motion stop device on weaving machines. This use is characterized in that a multiplicity of measuring feelers are arranged over the width of the warp, and each measuring feeler is assigned a sensing region of the warp, in that, during each sensing cycle, each measuring feeler counts the warp yarns of its sensing region, and in that the result of this count is compared with the known number of warp yarns of the respective sensing region.

BRIEF DESCRIPTION OF THE DRAWINGS

The invention is explained in more detail below by means of exemplary embodiment and the drawings, in which.

DETAILED DESCRIPTION OF PREFERRED EMBODIMENTS OF THE INVENTION

Figure 1:
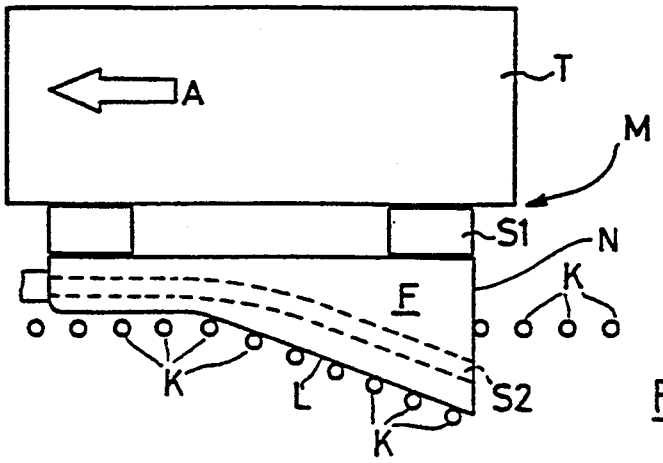
FIG. 1 shows schematically a feeler according to the invention, to explain the operating principles thereof.

FIG. 1 shows diagrammatically a row of tensioned yarns K which form a yarn set or yarn layer, for example a weaving warp. Above or below this yarn layer is arranged a measuring feeler M which is displaceable transversely to the yarns K in the direction of the arrow A (i.e., transversely of the direction of yarn travel) and which has, among other things, a yarn-guide part F and a carrier T for the latter. The yarn-guide part F is mounted on its carrier T via a pressure-sensitive sensor S1 which is formed by a piezo electric converter and which serves for detecting pressure changes between the yarn-guide part F and carrier T.

As illustrated, the yarn-guide part F is made saw-tooth-like in that it comprises a guide flank L and a steep flank N. The guide flank L extends in a wedge-shape manner. That is, the guide flank L is inclined obliquely relative to the plane defined by the row of yarns. When each yarn contacts the flank L, the yarn is deflected temporarily out of its path and tensioned. After the maximum tension at the tip of the flank L has been reached, the yarn jumps back into its initial position again. The yarn-guide part F thereby experiences an abrupt relief of the loading thereof which is recorded clearly by the pressure-sensitive sensor S1.

As is shown in FIG. 1, the yarn-guide part F has on its steep trailing flank N, i.e., in the region between its lower tip and the plane of the yarns K in the initial (undeflected) state, a sensor S2 which may comprise an optical or capacitive sensor. If an optical sensor is used, such a sensor could be formed by a light barrier and which is crossed without fail by the yarn K when the yarn jumps back into the initial position. The optical sensor S2 thus confirms each signal of the pressure-sensitive sensor S1.

Figure 2:
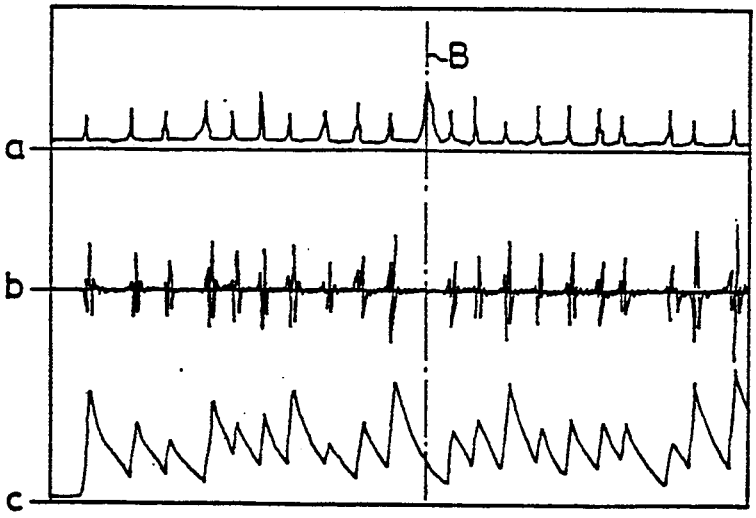
FIG. 2 shows a graph of the signals obtained by a feeler according to the present invention.

FIG. 2 shows the typical trend of the analog signal from the optical sensor S2 (line a) and from the pressure-sensitive sensor S1 (line b); line c shows the signal obtained by rectification and filtering from the direct signal of the pressure-sensitive sensor S1 represented in line b. For an optical conversion of the analog signal from the optical sensor S2 into a countable digital signal, the analog signal is smoothed and amplified and subsequently divided into two signals, of which one is guided to a differential comparator for edge recognition and the other is conveyed to an adjustable DC comparator for level recognition. Pulses which are too short are subsequently suppressed by means of an integrator.

In each sensing cycle, the number of pulses is counted and compared with the known number of yarns that are supposed to be present during this cycle. If a difference occurs, it is assumed that there is a yarn break and the corresponding textile machine is stopped.

The combination of the two sensors S1 and S2 has, in addition to the redundancy brought about by the multiple measurement of each yarn, the particular advantage that broken and therefore loose yarns are recognized more effectively and more reliably. As shown by the signal region marked by a dot-and-dash line B, a loose yarn on the one hand produces a wider signal from the optical sensor S2 (line a), but on the other hand the corresponding signal from the pressure-sensitive sensor S1 is absent. Thus, the wider signal from the light sensor together with the absence of a simultaneous pressure signal constitutes a corroborated indication that a yarn is broken. Moreover, that indication is immediate, i.e. it is not necessary to await the end of the counting cycle to receive the indication, of a broken yarn as in the case of a pure counting method.

The combination of the two sensors S1 and S2 is also advantageous when double yarns are present. Although double yarns should be recognized from the number of yarns counted by the pressure-sensitive sensor S1 itself (since a double yarn applies a greater load than a single yarn; see in this respect U.S. Pat. No. 4,805,276), the special conditions occurring during operations on weaving machines can mean that this is not so. However, the optical sensor S2 will generate an extremely wide pulse which, together with the signal from the pressure-sensitive sensor S1 (indicating a single yarn) is then taken into account accordingly in the check of the result of the count.

Figure 3:
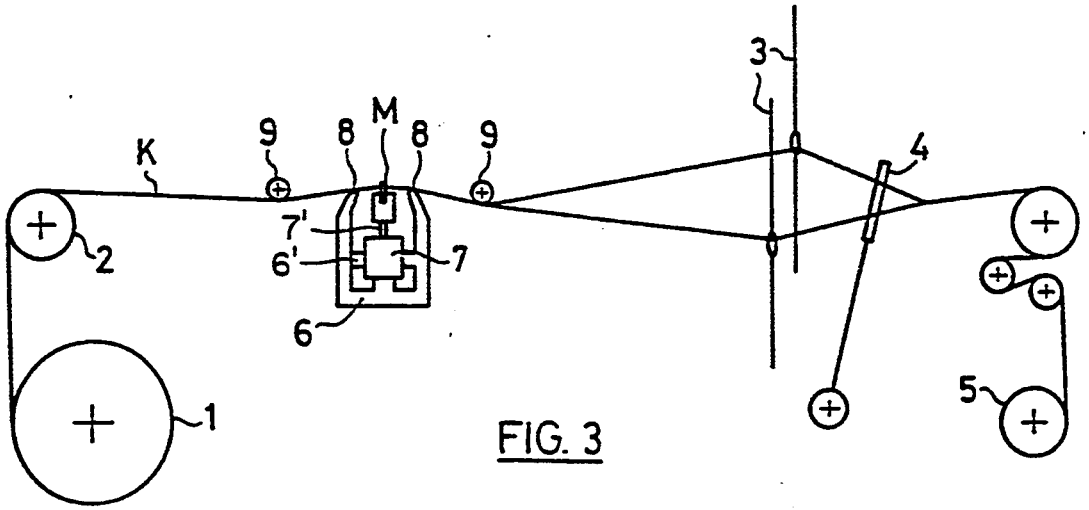
FIG. 3 shows a diagrammatic side view of a weaving machine equipped with feelers according to the present invention.

FIG. 3 shows the arrangement of the measuring feeler M illustrated in FIG. 1 on a weaving machine which has a warp beam 1, a back rest 2, heads 3, a weaving reed 4 and a cloth beam 5. The representation is not true to scale, in that the measuring feeler M and the parts assigned to it are shown too large in relation to the parts of the weaving machine.

The feeler M is mounted on a carrier 7 which includes a suitable actuator 7′ for raising and lowering the feeler M. The carrier 7 is mounted in a frame or housing 6 which also carries an actuator 6′ for moving the carrier 7 horizontally and transversely of the direction of yarn travel A. That is, the actuator 6′ moves the carrier 7 perpendicularly to the plane of the paper in FIG. 3. The actuators 6′ and 7′ can be of any suitable type, such as conventional fluid actuated cylinders for example. The housing 6 also carries yarn supports 8 arranged on both sides of the feeler M.

A corresponding number of measuring feelers M are arranged over the width of the warp at intervals of approximately 10 to 20 cm in the carrier 7 which thus defines a common carrier for the feelers. The measuring feelers M are driven in oscillation by the actuator 6′ and sense their sensing region approximately six times per second.

Figure 8:
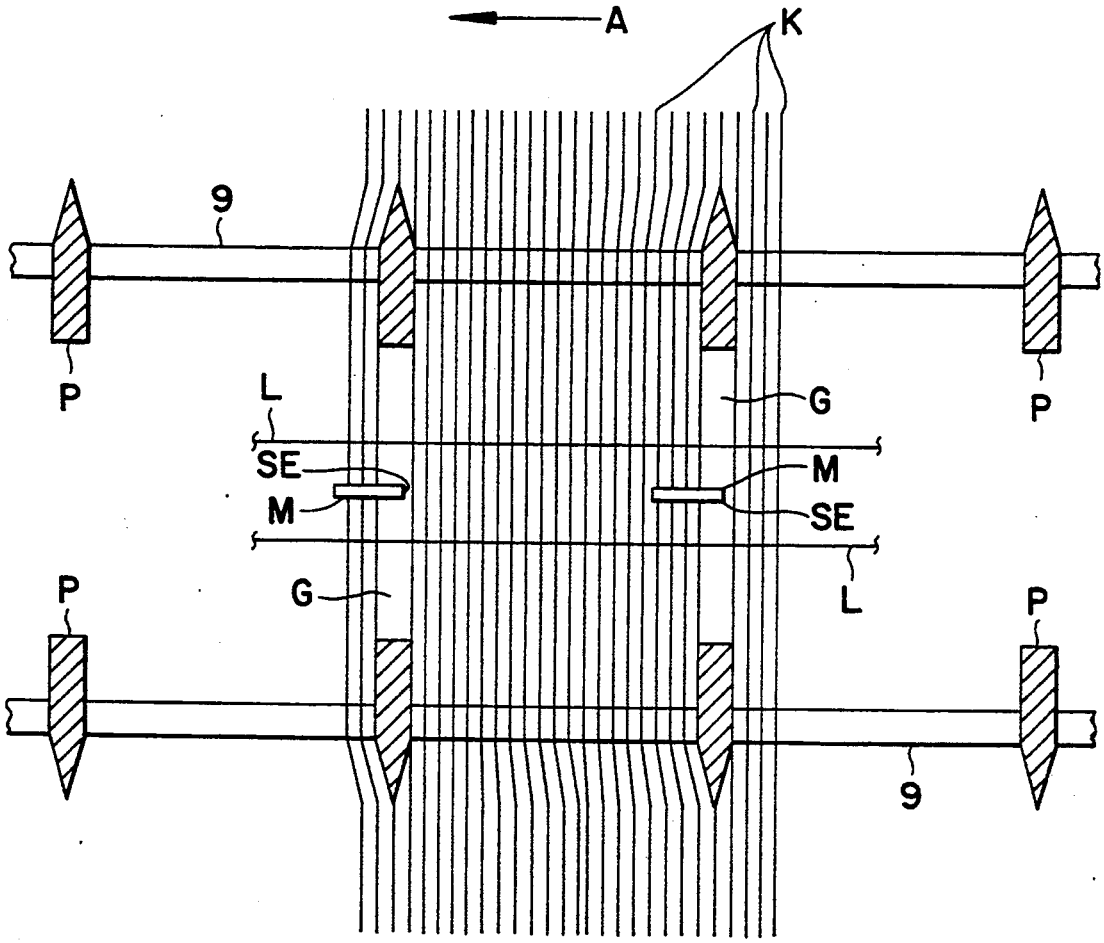
FIG. 8 is a schematic plan view of a mechanism for spreading the yarns of a layer of yarns.

The sensing regions can be defined by suitable means, such as, for example, by combs or separating plates P (shown in FIG. 8), which subdivides the yarns K into rows or sectors which each contain no more than approximately 100 yarns. The plates P are carried by the holding-down rods 9 described subsequently. Each measuring feeler M would then count the yarn number in its sector and compare it with a predetermined value. It can be assumed that, in these small yarn numbers, random measuring errors would not occur under any circumstances in a plurality of successive measurements. When reaching the ends of their sectors the feelers M would be displaced by the actuator 7′ out of contact with the yarns, and the actuator 6′ would return the feelers M to their start positions. Then the actuator 7′ would displace the feelers back into contact with the yarns for the next measuring operation. The plates P serve to create gaps G separating adjacent yarn sectors, as shown in FIG. 8, to ensure that each feeler will make contact only with the yarns of its own sector.

For additionally improving the guidance of the yarns K in the region of the measuring feelers M, stationary yarn guides are provided on opposite sides of the carrier 7 in the form of the transverse holding-down rods 9 which press the yarns downwardly onto the yarn supports 8 of the carrier 7. The supports 8, together with the holding-down rods 9, assume decisive importance for the reliability of the measurement. On the one hand, they have the function of keeping the distance between the yarn layer and the respective measuring feeler constant, and on the other hand they have to ensure that the yarns K lie parallel in the measuring zone and have no crossing points, even when the weaving machine is running.

It has been shown that the best results are achieved by introducing a lease. This is because the warp yarns are thereby separated as effectively as possible and are free of entanglement. Moreover, one warp-yarn layer is divided by the lease into two yarn layers crossing one another, so that the density of the warp yarns in the measuring zone is halved.

Figure 4:
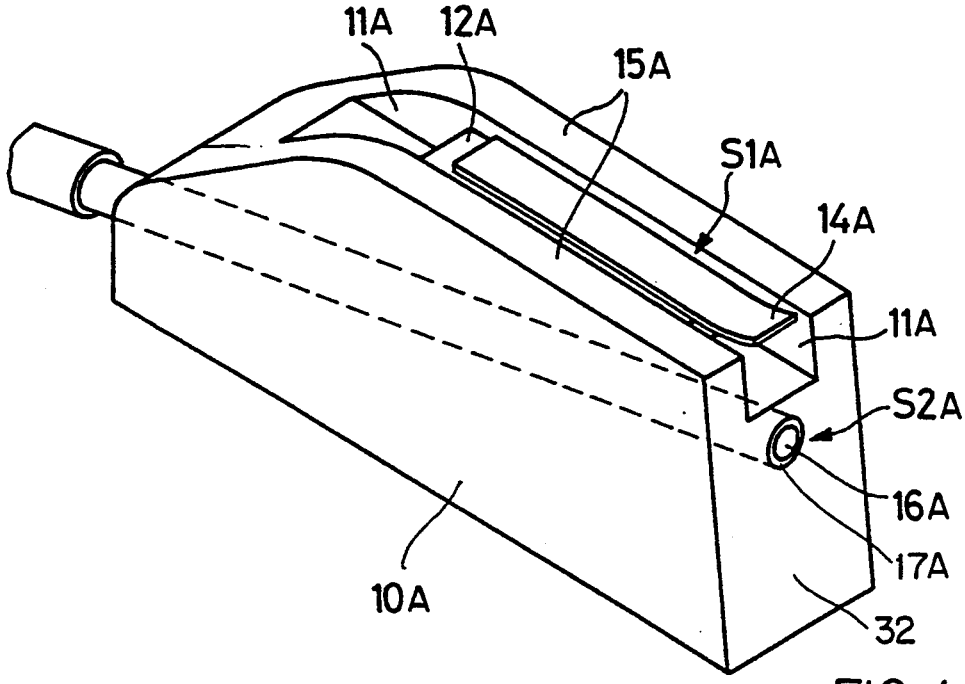
FIG. 4 is a perspective view of one preferred feeler according to the present invention.
Figure 5:
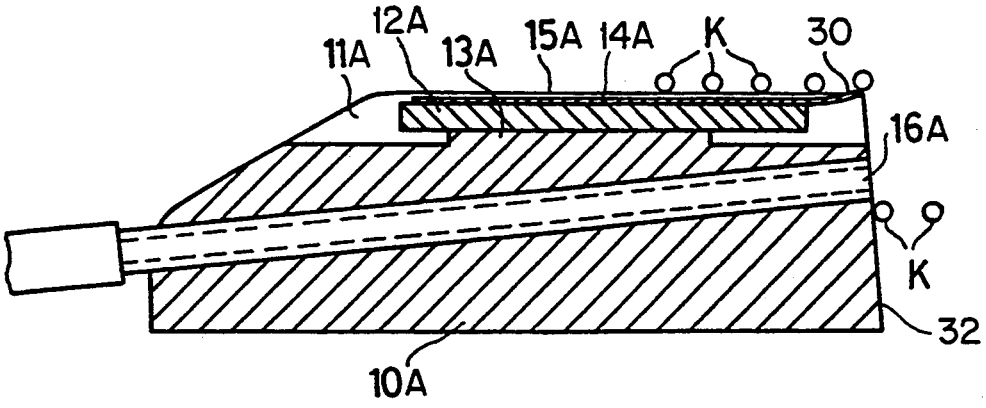
FIG. 5 is a longitudinal sectional view of the feeler depicted in FIG. 4 as that feeler traverses a row of yarns.
Figure 6:
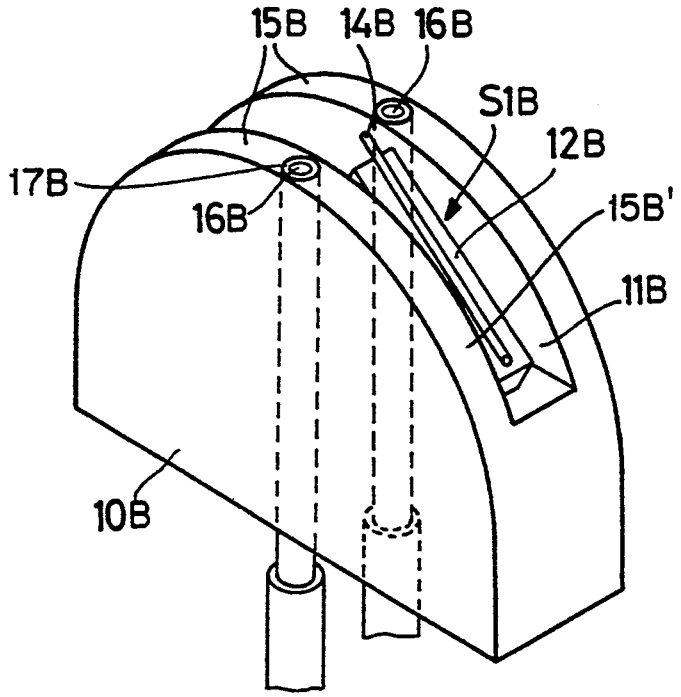
FIG. 6 is a perspective view of another preferred feeler according to the present invention.
Figure 7:
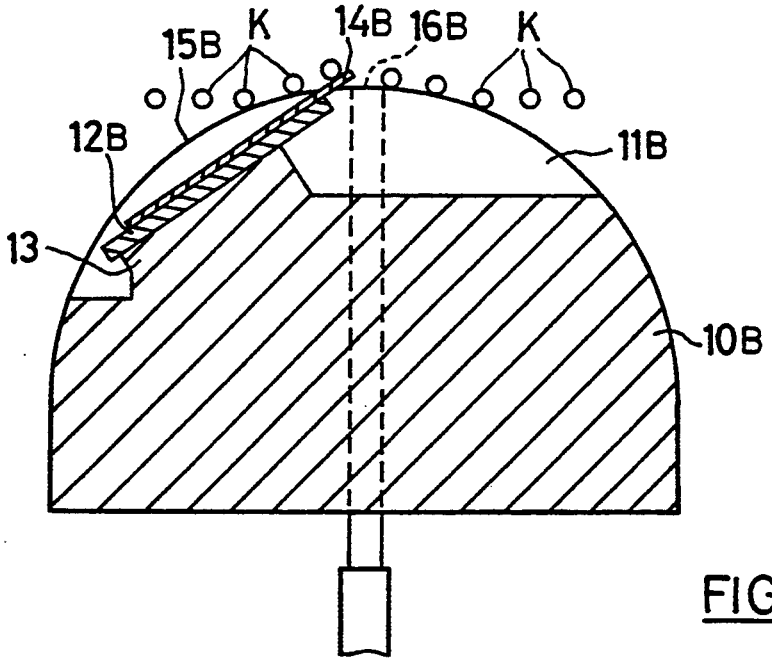
FIG. 7 is a longitudinal sectional view of the feeler depicted in FIG. 6 as that feeler traverses a row of yarns.

FIGS. 4–5 and 6–7 illustrate two exemplary embodiments of the measuring feeler M which differ essentially only in the form of their carrier and in the position of the optical sensor. FIGS. 4 and 6 show perspective representations of the respective measuring feelers and FIGS. 5 and 7 show longitudinal sections through the respective measuring feelers.

Each of the two embodiments has a housing 10A (or 10B) which possesses, on its edge facing the yarns K, a groove-shaped or slot-shaped recess 11A (or 11B) for receiving the pressure-sensitive sensor S1A (or S1B). The latter consists, as illustrated, of a bimorphous piezo electric bar 12A (or 12B), which is fastened to a holding web 13A (or 13B) forming part of the floor of the recess 11A (or 11B), and of a thin force transducer 14A (or 14B) adhesively bonded to the piezo electric bar 12A (or 12B) and taking the form of an elongate plate or of a sufficiently rigid metal foil or bar. The design and dimensioning of the sensor S1A (or S1B) consisting of the piezo electric bar 12A (or 12B) and force transducer 14A (or 14B) must take account of the fact that: (i) rigid sensors bring about a better yarn separation, (ii) the sensors usually have a plurality of self-resonant frequencies which should not be too close to one another in order to avoid disturbing beats, and (iii) in order to allow a high counting rate, the natural frequency and also the damping determining the dying-out time should be high.

The web-like side walls of the housing 10A (or 10B), which form the recess 11 and which straddle the force transducer 14A (or 14B) each form, on their upper edge facing the yarns K, a straight sliding face 15A (see FIG. 4–5) or an upwardly curved sliding face 15B (FIG. 6–7) for the yarns, which serves for feeding them in an ordered manner to the force transducer 14A (or 14B). At the same time, the sliding faces and the force transducers are so arranged relative to one another that the sliding faces or first guide segments 15A (or 15B) project above the level of the force transducer 14A (or 14B) at the yarn entry end of the force transducer 14A (or 14B) (i.e., the end on the left in FIGS. 5 and 7), and that the force transducer 14A (or 14B) protrudes beyond the level of the sliding faces 15A (or 15B) at its sensing end. This is achieved in that the force transducer either is arranged parallel to the plane of the yarns K and is bent upwards at its sensing end (see force transducer 14A in FIGS. 4 and 5), or that it is arranged at an inclination to the plane of the yarns K (see force transducer 14A in FIGS. 6 and 7). It is essential in both instances that the sensing end of the force transducer projecting beyond the associated end of the piezo electric bar 12A (or 12B) protrudes beyond the path defined by the sliding faces 15A (or 15B) and intersects the plane of the yarns K, so that the yarns can come into contact with it.

Each optical sensor S2A, S2B contains at least one inner light guide 16A (or 16B) which is coaxially arranged within an outer light guide 17A (or 17B). The inner guide 16A directs light from an emitter, whereas the outer guide 17A receives light which has reflected off a yarn and delivers that light to the analyzing mechanism. In the exemplary embodiment of FIGS. 4 and 5, the light guides 16A, 17A are arranged in a similar way to that shown in FIG. 1 and open out onto the sharply descending rear end face or second guide segment 32 of the housing 10A, specifically at a level between the force transducer 14A and the initial or normal position of the yarns K. In this arrangement, each yarn falling off the force transducer 14A and jumping back into its initial position crosses the beam emitted by the inner light guide 16A and causes the light beam to be reflected to the outer light guide 17A, thereby triggering a corresponding signal. As noted earlier, a capacitive sensor could be used instead of the optical sensor.

In the exemplary embodiment of FIGS. 6 and 7 having the bar-shaped force transducer 14B, a pair of light guides 16B, 17B arranged on both sides of the force transducer 14B is provided. These are guided vertically in the housing 10B, and their ends open out directly after the sensing end of the force transducer 14B onto the sliding faces 15B. In particular, the optical sensor opens at a transition region between the two curved flanks of each sliding face 15B. Since, in this exemplary embodiment, the sliding faces or second guide segments 15B' continue past the force transducer 14B, the yarns K, after falling off from the force transducer 14B, do not jump back into their initial position abruptly, but rather are guided gradually back into the initial position by the downwardly curved guide segments 15B'. The yarns K at the same time cross the light guides 16B, with the result that a corresponding signal is generated.

The length of the piezo electric bar 12A (or 12B) and the free length of the force transducer 14A (or 14B) (i.e., the length by which the force transducer projects above the piezo electric bar), are of the order of millimeters, and the thickness of the force transducer 14A (or 14B) is of the order of $10^{-2}$ to $10^{-1}$ millimeters.

Practical tests on weaving machines have shown that the error rate of a measuring feeler according to the present invention is around one error per 10,000 measurements under favorable conditions. This value applies to running weaving machines and to measuring feelers, the drive of which is synchronized with the weaving machine; on a stationary machine, the error rate is substantially lower still. This difference between a stationary and a running weaving machine is attributable not only to the vibrations, but above all to the non-uniform longitudinal movement of the warp yarns as a result of the shed opening and reed knock-on when the weaving machine is running.

Although the pressure sensor has been described as generating a signal when the yarn-induced loading of the force transducer is relieved by the exiting of a yarn therefrom, it could just as well generate a signal when the loading is applied to the force transducer.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. Apparatus for checking the presence of yarns of a tentered yarn layer on a textile machine, comprising a frame, a feeler mounted to said frame for movement relative thereto, and an actuator for moving the feeler relative to a row of the yarns in a direction transversely of a direction of yarn travel and including yarn deflecting means for temporarily deflecting each yarn such that loads are applied to said deflecting means as said deflecting means encounters respective yarns, and sensing means for sensing the loads to provide a signal indicating a presence-related status of the yarns.

2. Apparatus according to claim 1, wherein said sensing means senses the relieving of the load from said yarn deflecting means as a yarn is disengaged from said deflecting means.

3. Apparatus according to claim 1, wherein said sensing means senses the appreciation of the loading to said yarn deflecting means as a yarn is disengaged from said deflecting means.

4. Apparatus according to claim 1, wherein said feeler further includes an optical sensor for detecting the yarns.

5. Apparatus according to claim 1 wherein said feeler further includes a capacitive sensor for detecting the yarns.

6. Apparatus according to claim 1, wherein said sensing means comprises a first sensing means, said yarn deflecting means further including second sensing means arranged to detect each yarn as the yarn relieves the loading applied to said yarn deflecting means.

7. Apparatus according to claim 6, wherein said yarn deflecting means comprising a substantially straight first guide segment oriented obliquely relative to a plane of said row of yarns for deflecting the yarns out of said plane, and a second guide segment arranged to permit the deflected yarns to return to said plane, said second sensing means being arranged adjacent to said second guide segment to detect the return travel of yarns toward said plane.

8. Apparatus according to claim 7, wherein said second sensing means is positioned along said second guide segment.

9. Apparatus according to claim 6, wherein said yarn deflecting means comprises a curved yarn guiding path formed by a first guide segment for guiding yarns away from a plane defined by said row and toward said first sensing means, and a curved second guide segment for guiding the yarns back toward said plane, said second sensing means being disposed to sense the yarns no sooner than the downstream end of said first guide segment.

10. Apparatus according to claim 9, wherein said second sensing means is positioned along said curved path.

11. Apparatus according to claim 9, wherein said second sensing means is disposed at a transition region between said first and second guide segments.

12. Apparatus according to claim 6, wherein said feeler comprises a pair of side walls spaced apart to form a recess therebetween, said recess opening toward said row of yarns, said first sensing means being disposed in said recess, said side walls defining sliding faces for guiding deflected yarns toward said first sensing means.

13. Apparatus according to claim 12, wherein said first sensing means comprises a pressure sensor including a piezoelectric converter and a force transducer attached thereto, said force transducer being elongated in a direction of travel of said feeler.

14. Apparatus according to claim 13, wherein said force transducer is arranged obliquely relative to a plane defined by said row of yarns, a sensing end of said force transducer projecting out of said recess to be engaged by yarns traveling along said sliding faces.

15. Apparatus according to claim 1, wherein said layer of yarns comprises a plurality of rows of yarns, a plurality of said feelers being provided for checking respective rows of yarns in said layer of yarns, said apparatus further including a common carrier on which all of said feelers are mounted, said carrier being mounted on said frame, means for moving said carrier relative to said frame transversely of the direction of yarn travel, and stationary yarn guides arranged to engage said layer of yarns on opposite sides of said carrier for pressing the yarns toward the feelers.

16. Apparatus according to claim 15, further including yarn supports carried by said carrier on opposite sides of said feeler for supporting the yarns pressed by said yarn guides, each yarn guide comprising a rod extending transversely of said direction of yarn travel.

17. Apparatus according to claim 15, further including means for subdividing said layer of yarns into said rows and for forming gaps between successive rows.

18. A method of checking the presence of a predetermined number of yarns of a tentered yarn layer on a textile machine, comprising the steps of:

traversing a feeler transversely of a direction of yarn travel to deflect all yarns currently disposed in said yarn layer;

causing a pressure sensor of said feeler to contact each deflected yarn and generate a first signal in response thereto, whereby a plurality of first signals are generated corresponding to respective ones of said deflected yarns;

causing a second sensor of said feeler to detect all yarns currently disposed in said yarn layer and generate a second signal in response thereto whereby a plurality of second signals are generated corresponding to respective ones of said detected yarns; and comparing the number of each of said first and second signals generated to a reference value, said reference value corresponding to said predetermined number of yarns.

* * * * *